United States Patent [19]

Braden et al.

[11] 4,009,648

[45] Mar. 1, 1977

[54] AIR CONDITIONER AIR FLOW CONTROL MECHANISM

[75] Inventors: Ralph S. Braden, Bellbrook; Edgar W. Stienecker; John Weibel, Jr., both of Dayton, all of Ohio

[73] Assignee: General Motors Corporation, Detroit, Mich.

[22] Filed: Oct. 3, 1975

[21] Appl. No.: 619,198

[52] U.S. Cl. ..... 98/40 V; 98/40 VM; 98/94 AC; 98/110

[51] Int. Cl.[2] ..... F24F 3/00; F24F 13/08

[58] Field of Search ..... 98/40 V, 40 VM, 121 A, 98/94 AC, 110, 113; 49/81, 74, 77, 88

[56] References Cited

UNITED STATES PATENTS

| | | | |
|---|---|---|---|
| 3,093,060 | 6/1963 | Emery | 98/40 VM |
| 3,177,797 | 4/1965 | Kennedy | 98/110 |
| 3,552,295 | 1/1971 | Armstrong | 98/110 |
| 3,662,668 | 5/1972 | Johnson | 98/40 V |
| 3,680,470 | 8/1972 | Neece | 98/110 |
| 3,735,691 | 5/1973 | Gofton et al. | 98/110 |
| 3,741,102 | 6/1973 | Kaiser | 98/110 |
| 3,780,640 | 12/1973 | Fruth | 98/110 |

*Primary Examiner*—John J. Camby
*Assistant Examiner*—Henry C. Yuen
*Attorney, Agent, or Firm*—D. D. McGraw

[57] ABSTRACT

A room air conditioner having oscillatable vertical vanes pivotally mounted to be driven by a horizontally movable notch tie bar which is oscillated in the direction of its length to provide horizontal air sweep. The vanes have a pressure relief arrangement in the form of a vertical living hinge integrally provided as a part of each vane to reduce breakage. The vanes are provided with drive arms terminating in pivot pins which are snapped into driving engagement with resilient arms formed on the tie bar.

1 Claim, 6 Drawing Figures

AIR CONDITIONER AIR FLOW CONTROL MECHANISM

The invention relates to room air conditioners and is directed to a sweep air deflecting structure for assembling oscillatable vertical vanes or louvers on a horizontal notch tie bar which is oscillatable in the direction of its length. The invention also encompasses the provision of pressure relief means on the vanes in the form of living hinges integrally incorporated into the vane structure.

The vane construction aspect of the invention more particularly includes a vane planar main body section provided with pivot supports and defining the vane leading edge portion, and a drive arm attached to the main body section and pivotally secured to a tie bar for transferal of linear oscillating movement of the tie bar into pivotally oscillating vane movement. The vane also includes a trailing edge planar air deflecting section attached to the main body section by a flexibly yieldable hinge section having a normal position maintaining the vane sections in a predetermined planar relation. The hinge section resists hinge movement from the normal position due to air impingement; however, it flexibly yields under potentially damaging outside force application to the trailing edge section to protect the vane and the tie bar from damage by such outside force application. Upon removal of such outside force, the hinge returns the trailing edge section so that it again assumes the predetermined planar relationship with the leading edge section.

Another aspect of the invention is the provision of a drive arm on each of the vanes extending from the vane pivot axis and generally parallel to the direction of air flow, each of the arms has a headed pivot pin thereon in spaced and axially parallel relation to the vane pivot axis. The tie bar has for each vane a pair of spaced resilient arms defining a pivot pin-receiving recess receiving the vane drive arm pivot pin in a snap-retention and removal relation to drive the vanes pivotally about their respective pivot axes upon linear movement of the tie bar.

IN THE DRAWINGS

Figure 1:
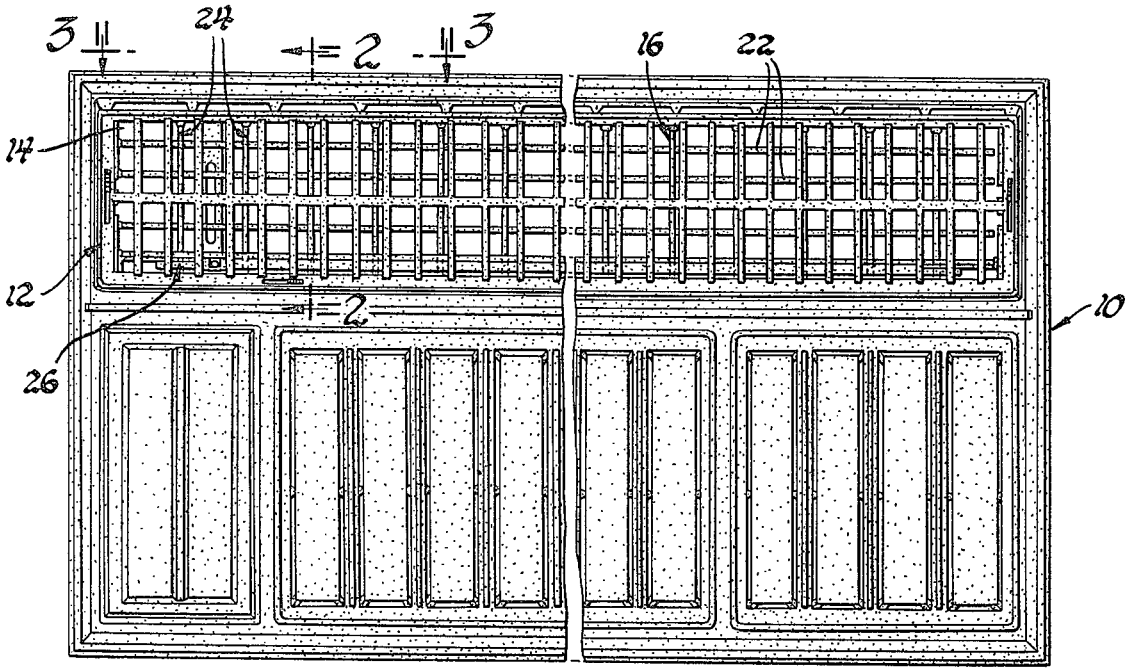
FIG. 1 is an elevation view of the front of a room air conditioner having a front and grill assembly.
Figure 2:
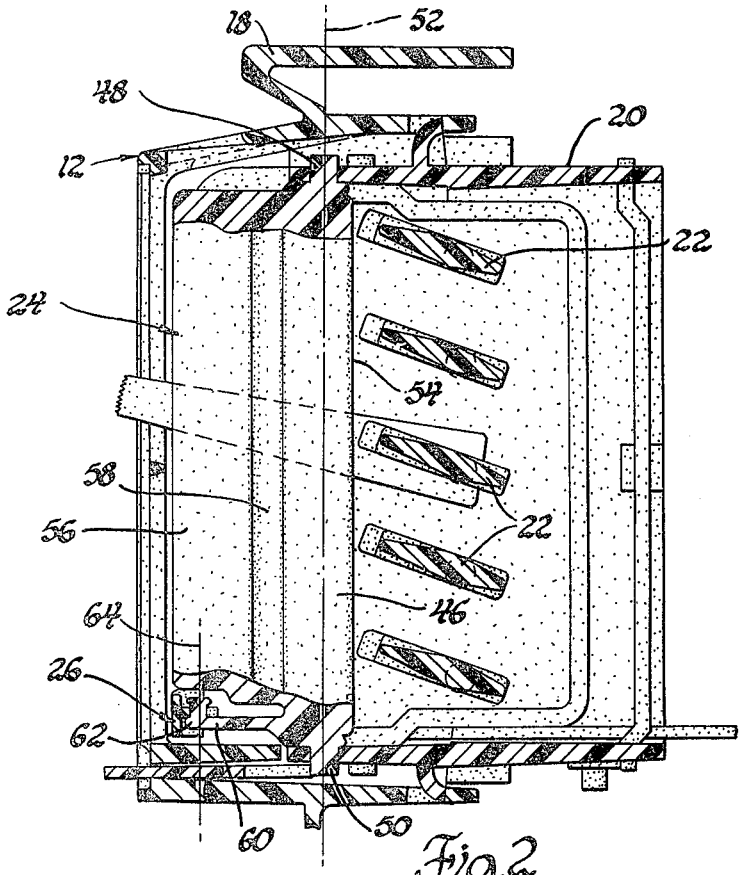
FIG. 2 is a vertical cross section view through the air flow portion of the unit taken in the direction of arrows 2—2 of FIG. 1.
Figure 3:
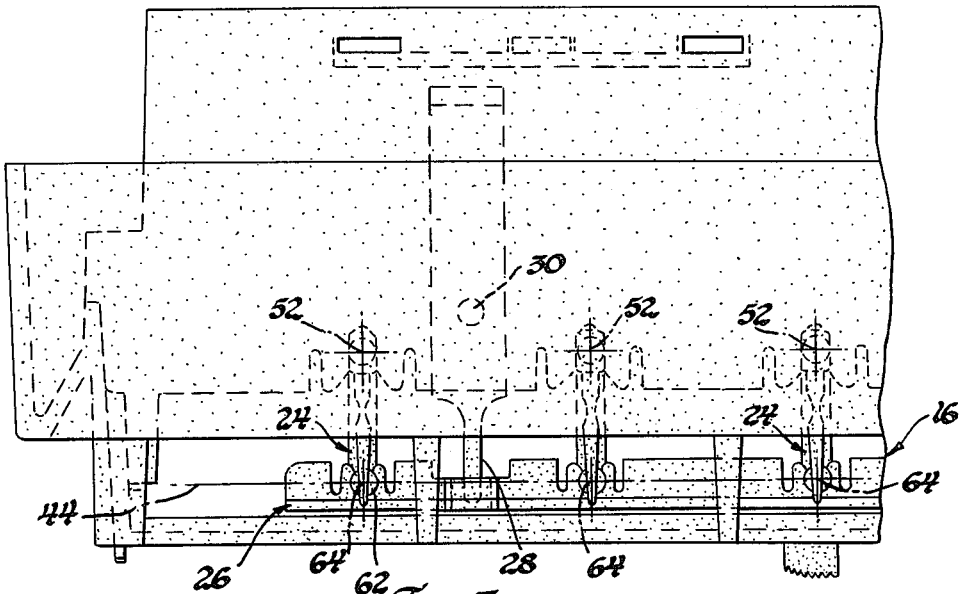
FIG. 3 is a plan view of a part of the air flow portion of the unit taken in the direction of arrows 3—3 of FIG. 1 and having parts broken away and in phantom.

The room air conditioner 10 is illustrated in FIG. 1 as having a front and grill assembly 12, the grill portion 14 thereof being at the upper part of the assembly and permitting the flow of conditioned air into the room in which the unit 10 is installed. Behind the grill is arranged a sweep air deflecting structure 16 which is shown in greater detail in the other figures. As shown in FIG. 2, the structure 16 includes a housing 18 mounted in the assembly 12 and providing a mounting for the frame means 20. Several horizontally extending louvers

22 are suitably mounted to the frame means 20 and control air flow in a vertical plane. A plurality of vanes 24 are pivotally supported by the frame means 20 to control horizontal air flow directions or sweep. A horizontally positioned notch tie bar 26 is mounted in the frame means 20 so as to be engaged by the tie bar drive member 28. This member is illustrated as being pivoted at 30 with the end of the member remote from tie bar 26 being suitably arranged to be driven by a motor or manually adjusted to obtain a desired horizontal air sweep under the control of the vanes 24. Since the particular drive arrangement forms no part of the invention, and various drive arrangements are well known, the manner in which the tie bar drive member 28 is driven is not further illustrated or described.

Figure 4:
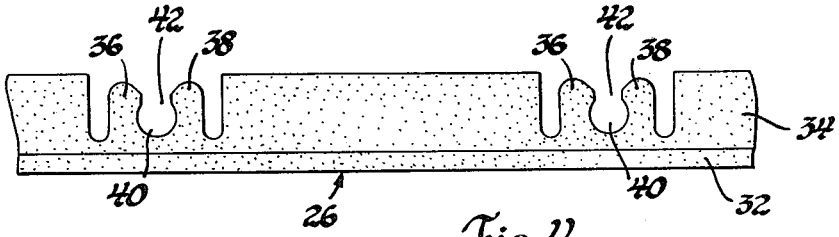
FIG. 4 is a plan view of a portion of the tie bar relating to the invention.

The tie bar 26 is illustrated in FIG. 4 to provide a better understanding of the manner in which the vanes 24 are attached thereto. The main body 32 of the tie bar has a planar section 34 extending therefrom in a horizontal plane adjacent the bottom portions of the vanes 24. At spaced intervals the section 34 is modified to provide a pair of spaced resilient arms 36 and 38 for each vane 24. The space between each pair of arms provides a recess 40, with a gate 42 being slightly narrower than the recess is wide. Due to the resilient nature of the arms 36 and 38 this provides a snap retention and removal arrangement which cooperates with the vane drive pivot pin as will be described below. The tie bar is moved along a line of linear oscillation identified by the reference numeral 44 as the tie bar drive member 28 is pivoted in a horizontal plane about its pivot 30. Since several vanes are assembled to the tie bar, they have a parallelogram-like movement in relation to the tie bar. They also support the tie bar in position.

Figure 5:
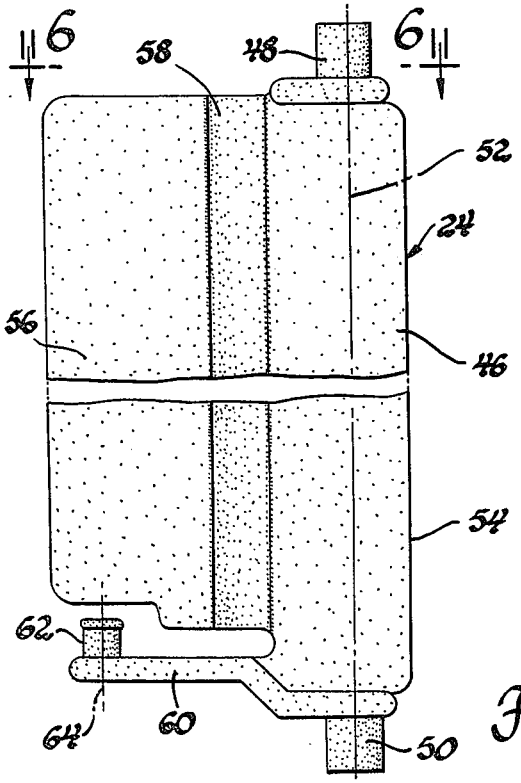
FIG. 5 is an elevation view of one of the vertical vanes of the air flow portion of the unit.
Figure 6:
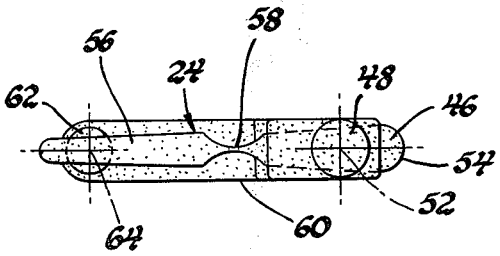
FIG. 6 is a top view of the vane of FIG. 5 as taken in the direction of arrows 6—6 of that FIGURE.

One of the vanes 24 is illustrated in greater detail in FIGS. 5 and 6, and in its installed position in FIG. 2. Only one vane will be further described in detail, it being understood that the other vertically extending vanes are similar. Vane 24 has a planar vane body section 46 provided with upper and lower pivot supports 48 and 50 which act as vane mounting means. They are received in apertures formed in the frame means 20 and lie along a vane pivot axis 52 which extends in a plane substantially perpendicular to the line 44 of linear oscillation of the tie bar 26. The main body section 46 defines a leading edge portion 54 which is aligned with the direction of air flow from the unit 10. In the particular construction illustrated, the leading edge 54 is adjacent but slightly spaced from the trailing edge of each of the louvers 22.

The vane 24 also has a trailing edge planar air deflection section 56 which is attached to the main body section 46 by a flexible yieldable hinge section 58. The hinge section provides a live hinge which maintains the vane sections 46 and 56 in a predetermined planar relation. In the particular embodiment shown, the sections 46 and 56 lie in the same plane. In the preferred construction, the vane sections are made of the same material in an integral manner, the hinge section 58 being somewhat thinner in cross section to provide the necessary flexibility and strength. The hinge section resists hinge movement from the normal position of vane section 56 relative to section 46 by air impingement. However, it is sufficiently flexible, when enough force is applied, to yield under potential damaging force application to permit deflection of the trailing edge planar air deflection section 56 so as to protect the vane 24 and the tie bar 26 from damage by such outside force application. This can occur, for example, when someone tries to manually move the vanes about their axes 52 or when a foreign object is forced against the vanes, and the mechanism resists such movement to the point of potential damage. The hinge section has a plastic memory so that when the outside force is no longer applied it will return the trailing edge section 56 to its normal position in relation to the leading edge section 46.

Vane 24 has a drive arm 60 extending substantially perpendicularly from the pivot axis and generally parallel to the direction of air flow. Arm 60 has a headed pivot pin 62 thereon in spaced and axially parallel relation to pivot axis 52. The axial relation is illustrated by the pivot pin axis 64 and its relation to axis 52 in FIGS. 2, 3, 5 and 6. The headed pivot pin 62 may be snapped through gate 42 and retained in recess 40 of the tie bar by the spaced resilient arms 36 and 38. Pivotal movement of the pin relative to the tie bar is permitted. The snap action of the arms 36 and 38 also permit removal of pin 62 when desired. The tie bar drives the vane 24 through pin 62 and drive arm 60 to provide the desired horizontal air sweep.

What is claimed is:

1. In a room air conditioner front and grill assembly having sweep air deflecting structure including a tie bar adapted to be oscillated in the direction of its length and pivotally oscillatable air deflecting vanes engaged in oscillatable driven relation with said tie bar to direct air flow from said assembly in a sweeping movement when said tie bar is oscillated and air is flowing through said assembly, the improvement comprising:

each of said vanes having a planar main body section provided with pivot supports and defining the leading edge portion of the vane, a drive arm attached to said main body section and to said tie bar for transferral of linear oscillating movement of said tie bar into pivotally oscillating vane movement, and a trailing edge planar air deflecting section attached to said main body section by a flexibly yieldable hinge section having a normal position maintaining said vane sections in a predetermined planar relation and resisting hinge movement from said normal position by air impingement but flexibly yielding under potentially damaging outside force application to said trailing edge planar air deflecting section to protect the vane and tie bar from damage by such outside force application, said trailing edge planar air deflecting sections being connected to said drive arms only through said flexibly yieldable hinge sections and said planar main body sections whereby all transferral of linear oscillating movements of said tie bar to said vane trailing edge planar air deflecting sections occurs through said flexibly yieldable hinge sections.

* * * * *